US006079842A

United States Patent [19]

Cheng

[11] Patent Number: 6,079,842

[45] Date of Patent: Jun. 27, 2000

[54] CHEMILUMINESCENT LIGHTING DEVICE

[75] Inventor: Kun-Chuan Cheng, Tainan, Taiwan

[73] Assignee: Kai Gee Enterprise Co., Ltd., Tainan, Taiwan

[21] Appl. No.: 09/243,428

[22] Filed: Feb. 3, 1999

[51] Int. Cl.[7] ..... F21K 2/00

[52] U.S. Cl. ..... 362/34

[58] Field of Search ..... 362/34, 806; 206/219

[56] References Cited

U.S. PATENT DOCUMENTS

| | | | |
|---|---|---|---|
| 4,715,564 | 12/1987 | Kinn et al. | 362/34 X |
| 5,158,349 | 10/1992 | Holland et al. | 362/34 |
| 5,508,893 | 4/1996 | Nowak et al. | 362/34 |
| 5,552,968 | 9/1996 | Ladyjensky | 362/34 |
| 5,938,313 | 8/1999 | Fujita | 362/34 |

*Primary Examiner*—Laura K. Tso
*Attorney, Agent, or Firm*—Rosenberg, Klein & Lee

[57] ABSTRACT

A multi-color chemiluminescent lighting device comprising a flexible tube containing an activator solution therein and a plurality of glass ampules containing oxalate solutions; characterized in the glass ampules are each connected to a central hole of a barrier element for a pointed closed end inserted into and then dispose the glass ampules in the flexible tube in succession. The glass ampules are protected from being prematurely broken because they are fixed by the barrier elements, and cannot collide with the barrier elements or the flexible tube during violent movement of the lighting device.

1 Claim, 4 Drawing Sheets

CHEMILUMINESCENT LIGHTING DEVICE

BACKGROUND OF THE INVENTION

Devices, which adopt chemical means to generate light, have been used for many years. Such chemiluminescent lighting devices can be used for many purposes, including military and novelty uses, for example, as a glow necklace and a luminous stick used by the participants of a party or concert.

Referring to FIG. 7, a heretofore known chemiluminescent lighting device, patented by the U.S. Patent and Trademark Office with U.S. Pat. No. 5,508,893, comprises an outer flexible tube 2, a plurality of fragile glass ampules 4, and barrier elements 10; the glass ampules 4 are each filled with a quantity of oxalate solution 6 with a respective dye contained therein; the glass ampules 4 are inserted into the outer flexible tube 2, and are surrounded by an activator solution 8 contained inside the flexible tube 2; the barrier elements 10 are each positioned between two adjacent ones of the glass ampules 4.

When the user bends the flexible tube 2 to break the glass ampules 4, the solutions 6 and 8 will contact, and generate light.

However, it is found that the above lighting device has undesirable features such as the glass ampules 4 can move along the flexible tube 2, and easily collide with the barrier elements 10; consequently they might break under violent movement. Once the glass ampules 4 are broken, the solutions 6 and 8 react with each other prematurely and cause the lighting ability of this device to be reduced greatly.

SUMMARY

It is an object of the present invention to provide an improved multi-color chemiluminescent lighting device.

It is another object of the present invention to provide a multi-color chemiluminescent lighting device, of which the colors are maintained in separate and distinct regions for a relatively long period of time after activation.

The main object of the present invention is to provide a multi-color chemiluminescent lightning device of which the glass ampules containing the oxalate solution are well protected from being unintentionally and prematurely broken during transportion or any violent movement so that the lighting device can have a good lighting effect as well as overcome the undesirable feature of the prior art device that the oxalate solution and the activator solution might react with each other due to the unintended breaking of the glass ampules caused by collision with the barrier elements or with the inner wall of the flexible tube.

The chemiluminescent lighting device of the present invention comprises a flexible tube and a plurality of glass ampules; the flexible tube has an activator solution contained therein; the glass ampules each has a first closed end, a second pointed closed end and contains an oxalate solution including a respective dye therein; each pointed end is inserted into and fixedly connected with a central hole of respective barrier element; the glass ampules are received in the flexible tube and surrounded by the activator solution.

The barrier elements are sized such that they can be passed into the flexible tube, and contact the inner wall of the flexible tube after the insertion such that the glass ampules are prevented from moving relative to the flexible tube or the glass ampules, protected from being prematurely broken under violent movement or transporation.

BRIEF DESCRIPTION OF THE DRAWINGS

The present invention will be better understood by reference to the accompanying drawings, wherein.

DETAILED DESCRIPTION OF THE PREFERRED EMBODIMENTS

Figures 1, 2:
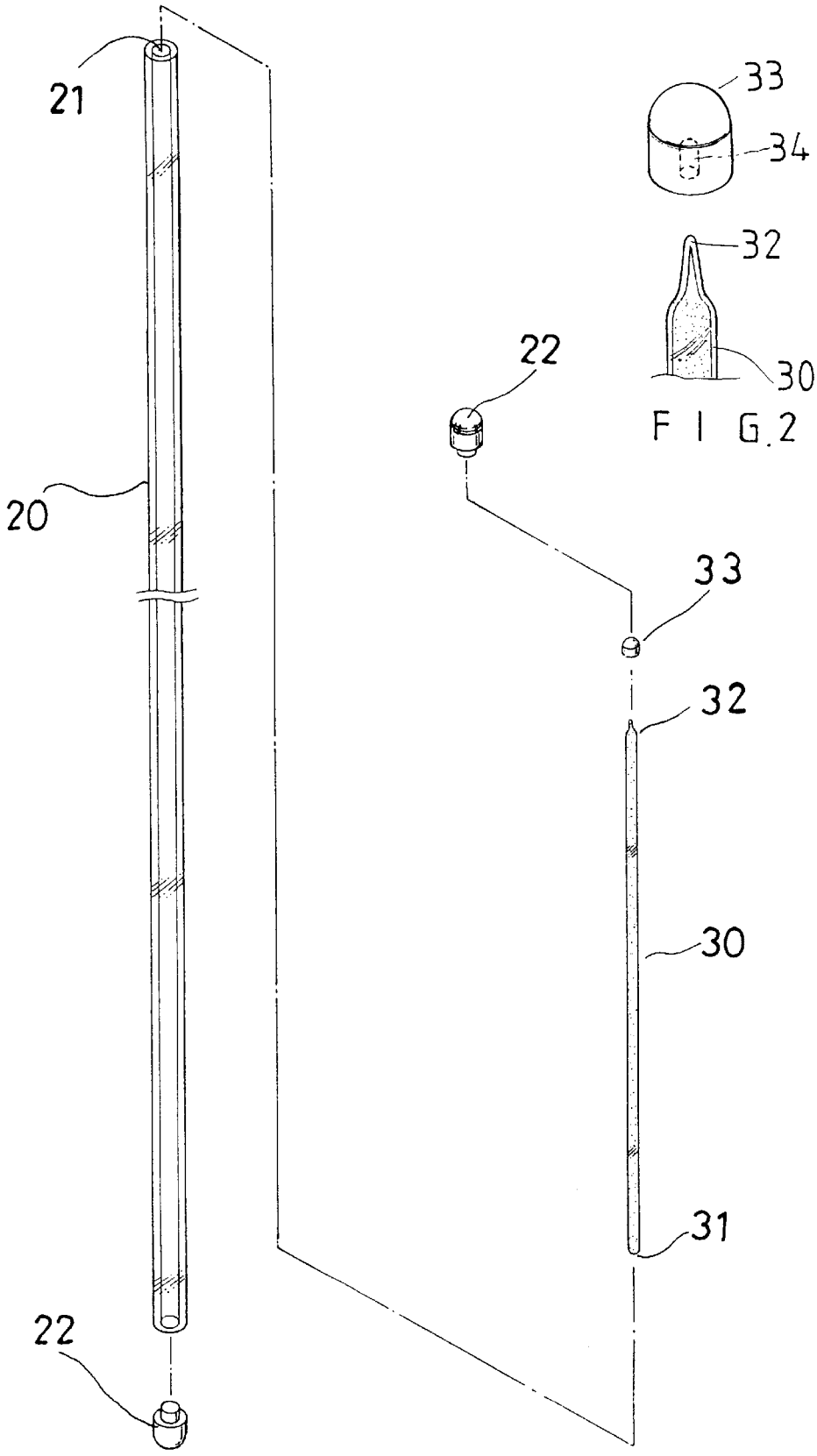
FIG. 1 is an exploded perspective view of a chemiluminescent lighting device of the present invention.
FIG. 2 is a fragmentary enlarged view of a barrier element of the present invention.
Figure 3:
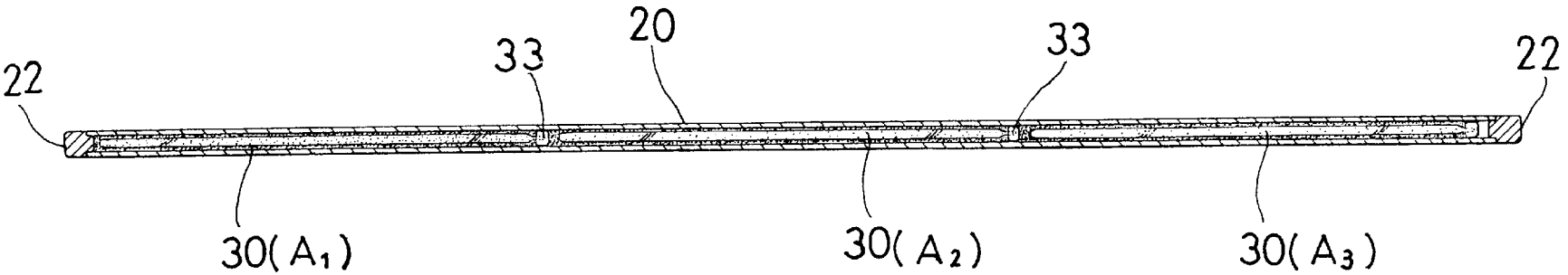
FIG. 3 is a cross-sectional view of the chemiluminescent lighting device of the present invention.
Figure 4:
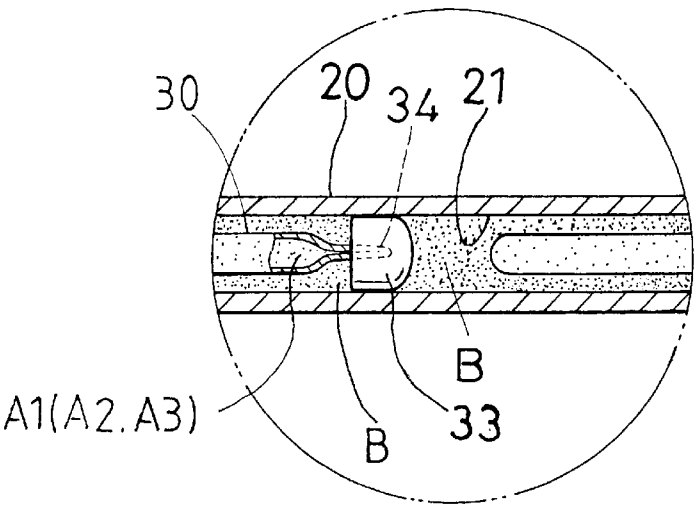
FIG. 4 is a fragmentary enlarged view of the chemiluminescent lighting device of the present invention.

Referring to FIGS. 1, 2 and 3, a chemiluminescent lighting device of the present invention comprises an outer flexible tube 20 and a plurality of glass ampules 30 as main parts.

The outer flexible tube 20 is made of a strong flexible plastic material.

The embodiment of the present invention shown in FIG. 3 has three glass ampules 30. Additionally, any ampules more than two may be employed. The glass ampules 30 are fragile such that they can be broken easily.

The outer flexible tube 20 has an inner containing room 21 and two open ends (not numbered), each of which is plugged up by a respective plug 22. The glass ampules 30 each has a first closed end 31, and a second pointed closed end 32, and contains a quantity of oxalate solution having a respective dye A1, A2 and A3; the dyes A1, A2 and A3 have different colors.

Each of the second pointed closed end 32 of the glass ampules 30 is inserted into a central hole 34 of barrier element 33 respectively such that the glass ampules 30 cannot move relative to the respective barrier elements 33.

The glass ampules 30 are inserted into the outer flexible tube 20, and surrounded by activator solution B contained inside the tube 20.

The barrier elements 33 are sized such that they can be passed into the outer flexible tube 20 and contact the inner wall of the outer flexible tube 20 after insertion of the same 33, having been coupled to the glass ampules 30, into the tube 20. The glass ampules 30 are prevented from moving relative to and colliding with the flexible tube 20 by the barrier elements 33 contacting the inner wall of the flexible tube 20.

Thus, the inner containing room 21 of the flexible tube 20 is separated into several rooms by the barrier elements 33. When the user breaches the glass ampules 30 by bending the outer flexible tube 20 to allow the oxalate solutions to react with the activator solution B for the chemiluminescent lighting device to generate light. The oxalate solutions including different dyes A1, A2 and A3 are impeded from mixing with one another by the barrier elements 33. Moreover, the glass ampules 30 cannot be broken due to collision with the barrier elements 33 or with the inner wall of the flexible tube 20 because the glass ampules 30 are fixedly connected to the respective barrier elements 33.

Figure 6:
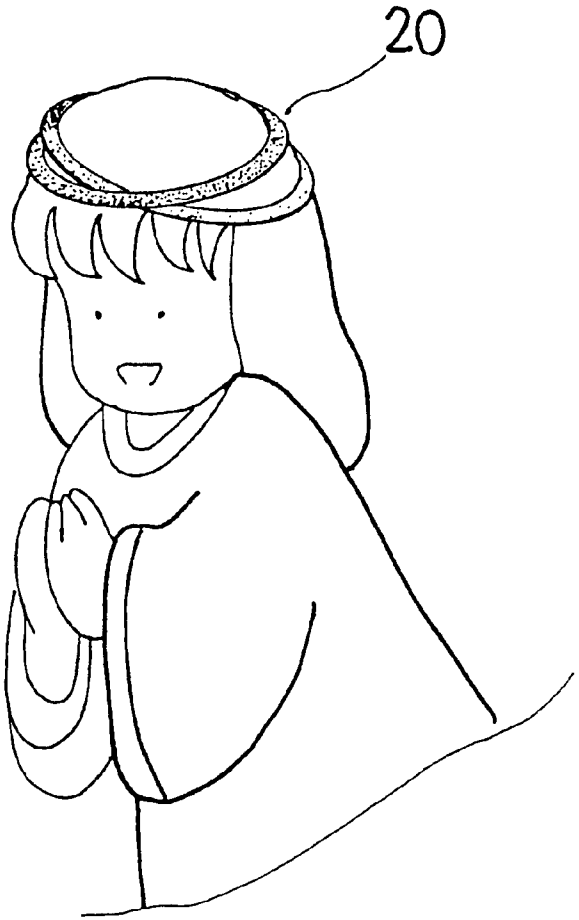
FIG. 6 is a view showing another embodiment of the present invention.
Figure 5:
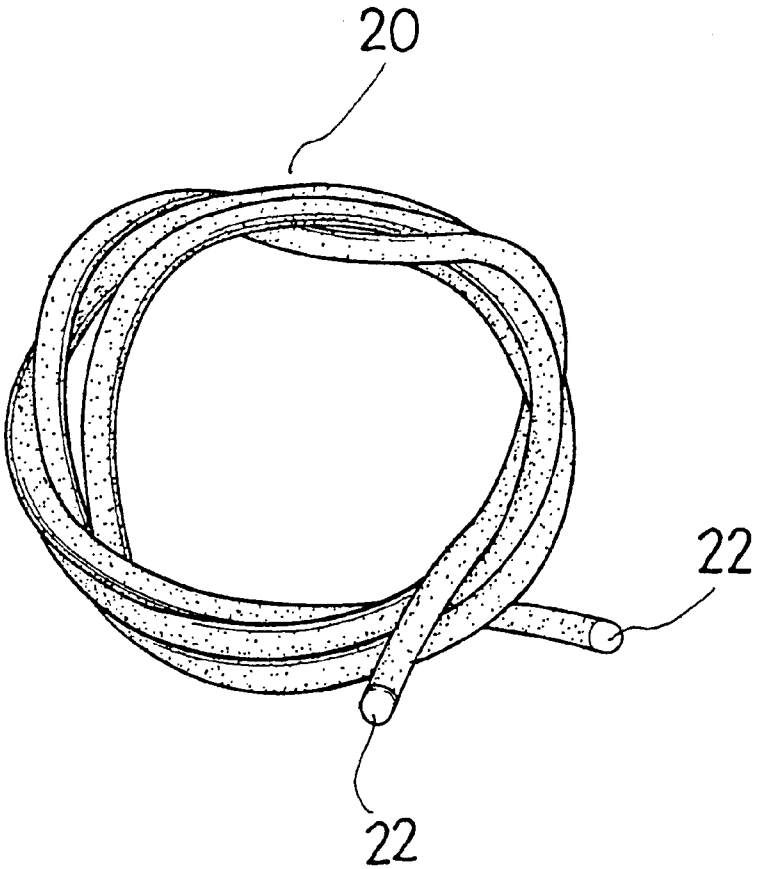
FIG. 5 is a view showing an embodiment of the present invention.
Figure 7:
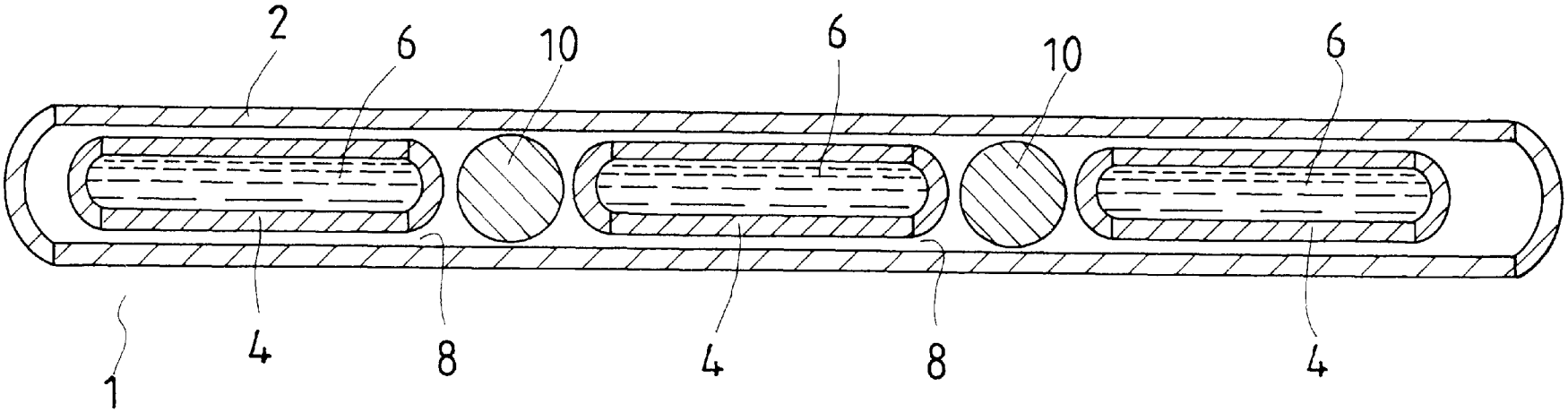
FIG. 7 (PRIOR ART)
FIG. 7 is a view showing the prior art chemiluminescent lighting device as described in the Background.

The flexible tube 20 is strong such that the chemiluminescent device can be wound around an object or shaped according to the user's demand, as shown in FIGS. 5 and 6.

From the above description, it can be understood that the multi-color chemiluminescent lighting device of the present invention has advantages as follows:

1. The barrier elements separate the inner space of the flexible tube into several substantially isolated chambers for permitting the colors to be maintained in separate and distinct regions after activation of the chemiluminescent device.
2. The glass ampules are protected from being prematurely broken thus the lighting effect of this device will not be reduced.

What is claimed is:

1. A multi-color chemiluminescent lighting device comprising:

a flexible tube containing a quantity of activator solution therein; a plurality of glass ampules each containing a quantity of oxalate solution therein; said glass ampules each having a first closed end and a second pointed closed end, said second pointed closed end of each said glass ampule being connected with a central hole of an adjacent barrier element, said glass ampules being inserted into said flexible tube in succession, said barrier elements being each sized to fit into said flexible tube and contact an inner wall of said flexible tube for separating said flexible tube into multiple regions, said glass ampules being prevented from moving by said respective barrier elements.

* * * * *